US012357040B2

(12) United States Patent
Handfield et al.

(10) Patent No.: US 12,357,040 B2
(45) Date of Patent: Jul. 15, 2025

(54) PROTECTIVE SHOULDER PADS WITH ADJUSTABLE FRONT PANEL

(71) Applicant: SPORT MASKA INC., Saint-Laurent (CA)

(72) Inventors: Marie-Jeanne Handfield, Montréal (CA); Ryan Brownridge, Saint-Basile-le-Grand (CA)

(73) Assignee: SPORT MASKA INC.

( * ) Notice: Subject to any disclaimer, the term of this patent is extended or adjusted under 35 U.S.C. 154(b) by 0 days.

(21) Appl. No.: 18/392,483

(22) Filed: Dec. 21, 2023

(65) Prior Publication Data

US 2024/0206570 A1 Jun. 27, 2024

Related U.S. Application Data

(60) Provisional application No. 63/476,779, filed on Dec. 22, 2022.

(51) Int. Cl.
*A41D 13/00* (2006.01)

(52) U.S. Cl.
CPC ..... *A41D 13/0017* (2013.01); *A41D 2600/10* (2013.01)

(58) Field of Classification Search
CPC ..... A41D 13/0017; A41D 13/0512; A41D 13/0518; A41D 13/0562; A41D 13/0568; A41D 13/0556; A41D 13/0153; A41D 13/015; A63B 71/08; A63B 71/12; A63B 71/1291; A63B 2071/1208; F41H 1/02
See application file for complete search history.

(56) References Cited

U.S. PATENT DOCUMENTS

| | | | | |
|---|---|---|---|---|
| 6,138,277 | A | 10/2000 | Gillen et al. | |
| 6,247,188 | B1 | 6/2001 | Beland | |
| 2007/0050884 | A1* | 3/2007 | Contant | A41D 13/0518 2/92 |
| 2009/0211001 | A1* | 8/2009 | Weimer | A63B 71/12 2/463 |
| 2011/0010829 | A1* | 1/2011 | Norman | A41D 13/0512 2/463 |

(Continued)

FOREIGN PATENT DOCUMENTS

WO WO-2021243453 A1 * 12/2021 ..... A41D 13/0512

*Primary Examiner* — Aiying Zhao
(74) *Attorney, Agent, or Firm* — NORTON ROSE FULBRIGHT CANADA

(57) ABSTRACT

Protective shoulder pads, having: a neck portion defining a neck opening; shoulder portions attached to the neck portion; and a front panel assembly extending from the neck portion. The front panel assembly includes: a central panel secured to the neck portion in a fixed position and extending downwardly from the neck portion along a centerline of the protective shoulder pad, side panels disposed on opposite sides of the centerline, and a movable panel overlapping the side panels, the movable panel extending transversely relative to the centerline and being movable relative to the central panel and along the centerline, the movable panel being positionable at a plurality of positions relative to the central panel, the plurality of positions including an upper-most position and a lower-most position, an overlapping area between the movable panel and the side panels greater in the upper-most position than in the lower-most positions.

19 Claims, 8 Drawing Sheets

(56) References Cited

U.S. PATENT DOCUMENTS

| | | | | |
|---|---|---|---|---|
| 2011/0167548 | A1 | 7/2011 | Jourde | |
| 2011/0307999 | A1* | 12/2011 | Jourde | A63B 71/12 2/462 |
| 2013/0104302 | A1 | 5/2013 | Fream | |
| 2017/0203191 | A1* | 7/2017 | Lemieux | A41D 13/0562 |
| 2017/0296903 | A1* | 10/2017 | Piombino | A63B 71/12 |
| 2019/0313712 | A1 | 10/2019 | Rusakov | |

* cited by examiner

PROTECTIVE SHOULDER PADS WITH ADJUSTABLE FRONT PANEL

CROSS-REFERENCE TO RELATED APPLICATION

This application claims priority to U.S. patent application No. 63/476,779 filed Dec. 22, 2022, the entire contents of which are incorporated by reference herein.

TECHNICAL FIELD

This disclosure relates generally to sporting goods and, more particularly, to protective equipment of the type worn for ice hockey or other athletic and/or sporting activities.

BACKGROUND

Hockey (e.g. ice hockey) players use protective shoulder pads that typically include a series of padded sections for protecting the chest, back, shoulders, and upper arm regions. These shoulder pads may be available in a variety of sizes to cater to different sizes of players. However, for some players, the shoulder pads may be too tight or small in certain areas and too loose or large in others. Improvements are therefore sought.

SUMMARY

In one aspect, there is provided protective shoulder pads, comprising: a neck portion defining a neck opening configured for receiving a head of a wearer; shoulder portions attached to the neck portion and configured for covering shoulders and parts of arms of the wearer; and a front panel assembly extending from the neck portion and configured for covering a chest of the wearer, the front panel assembly having: a central panel secured to the neck portion in a fixed position and extending downwardly from the neck portion along a centerline of the protective shoulder pad, side panels disposed on opposite sides of the centerline, and a movable panel overlapping the side panels, the movable panel extending transversely relative to the centerline and being movable relative to the central panel and along the centerline, the movable panel being positionable at a plurality of positions relative to the central panel, the plurality of positions including an upper-most position and a lower-most position, an overlapping area between the movable panel and the side panels greater in the upper-most position than in the lower-most positions.

The protective shoulder pads defined above and described herein may also include any one or more of the following features, in whole or in part, and in any combination.

In some embodiments, the front panel defines a chest-receiving cavity for receiving a portion of the chest, the chest-receiving cavity is greater in depth in the lower-most position than in the upper-most position of the movable panel, the depth extending from the front panel towards a rear panel facing a back of the wearer.

In some embodiments, the movable panel rotates about an axis transverse to the centerline when moving downwardly along the centerline to increase a distance between the side panels and a rear panel of the protective shoulder pads facing a back of the wearer.

In some embodiments, upper ends of the side panels are fixed relative to the neck portion, lower ends of the side panels being displaceable transversally to the centerline and relative to the central panel and the neck portion to adjust a width of the front panel assembly, the width defined between outer lateral edges of the side panels.

In some embodiments, the movable panel is securable to the side panels at both of the upper-most position and the lower-most position.

In some embodiments, the movable panel is securable to the side panels at a plurality of intermediate positions between the upper-most position and the lower-most position.

In some embodiments, lower ends of the side panels are detachably secured to the movable panel.

In some embodiments, a curvature defined by the side panels is greater in the lower-most position than in the upper most position of the movable panel.

In some embodiments, the central panel overlaps the movable panel.

In some embodiments, the central panel is disposed over the movable panel such that the movable panel is disposed between the central panel and a wearer of the shoulder pad.

In some embodiments, the movable panel extends laterally from a first lateral edge to a second lateral edge, the first lateral edge and the second lateral edge detachably securable to a rear panel of the protective shoulder pad.

In some embodiments, a first strap is secured to the central panel and a second strap secured to the movable panel, the first strap interlaced with the second strap to constrain an amplitude of movements of the movable panel relative to the central panel.

In another aspect, there is provided protective shoulder pads having a front panel assembly, the front panel assembly comprising: a sternum-covering panel extending along a centerline of the protective shoulder pads from a top edge to a bottom edge; chest-covering panels disposed on opposite sides of the centerline, the chest-covering panels and the sternum-covering panel conjointly defining a chest-receiving cavity having a depth extending transversally to the centerline, and a movable panel extending transversally to the sternum-covering panel and being movable along the centerline relative to the sternum-covering panel at any point between an upper-most position and a lower-most position, the movable panel rotatable about an axis transverse to the centerline with a movement of the movable panel along the centerline to vary the depth of the chest-receiving cavity, the depth of the chest-receiving cavity greater in the lower-most position than in the upper-most position of the movable panel.

The protective shoulder pads defined above and described herein may also include any one or more of the following features, in whole or in part, and in any combination.

In some embodiments, the movable panel overlaps the chest-covering panels and is at least partially overlapped by the sternum-covering panel.

In some embodiments, upper ends of the chest-covering panels are fixed relative to the sternum-covering panel, lower ends of the chest-covering panels being displaceable transversally to the centerline and relative to the sternum-covering panel to adjust a width of the front panel assembly.

In some embodiments, the movable panel is securable to the side panels at both of the upper-most position and the lower-most position.

In some embodiments, the movable panel is securable to the chest-covering panels at a plurality of intermediate positions between the upper-most position and the lower-most position.

In some embodiments, lower ends of the chest-covering panels are detachably secured to the movable panel.

In some embodiments, a curvature defined by the chest-covering panels is greater in the lower-most position than in the upper-most position of the movable panel.

In some embodiments, a first strap is secured to the sternum-covering panel and a second strap secured to the movable panel, the first strap interlaced with the second strap to constrain an amplitude of movements of the movable panel relative to the sternum-covering panel.

In accordance with yet another aspect, there is provided a protective shoulder pad, comprising: a neck portion defining a neck opening configured for receiving a head of a wearer; shoulder portions attached to the neck portion and configured for covering shoulders and parts of arms of the wearer; and a front panel assembly extending from the neck portion and configured for covering a chest of the wearer, the front panel assembly having: a central panel secured to the neck portion in a fixed position and extending downwardly from the neck portion along a centerline, side panels disposed on opposite sides of the centerline of the central panel, and a movable panel overlapping the side panels and located at least partially below the central panel, the movable lower panel extending transversely relative to the centerline, the movable lower panel being vertically movable relative to the central panel between at least two positions, an overlapping area between the movable panel and the side panels varying between the at least two positions, a distance between an upper edge of the movable panel and the neck portion varying between the at least two positions.

The protective shoulder pad defined above and described herein may also include any one or more of the following features, in whole or in part, and in any combination.

In certain aspects, the at least two positions include a first position and a second position, the movable panel located closer to the neck opening in the first position than in the second position.

In certain aspects, a chest-receiving cavity of the front panel is greater in depth in the second position than in the first position of the movable panel.

In certain aspects, upper ends of the side panels are fixed relative to the neck portion, lower ends of the side panels being laterally displaceable relative to the central panel and the neck portion to adjust a width of the front panel assembly defined between outer lateral edges of the side panels.

In certain aspects, lower ends of the side panels are detachably secured to the movable panel.

In certain aspects, the side panels are rotatable about the upper ends to adjust the width of the front panel assembly.

In certain aspects, the movable panel rotates about an axis transverse to the centerline as the movable panel translates from the first position to the second position.

In certain aspects, the chest-receiving cavity of the front panel increases in depth via the rotation of the movable panel about the axis transverse to the centerline.

In certain aspects, a curvature defined by the side panels is greater in the second position than in the first position of the movable panel.

In certain aspects, the central panel overlaps the movable panel.

In certain aspects, the central panel is disposed over the movable panel such that the movable panel is disposed between the central panel and a wearer of the shoulder pad.

In certain aspects, the central panel is detachably securable to the movable panel.

In certain aspects, a fastener is provided between the central panel and the movable panel.

In certain aspects, the movable panel extends laterally from a first lateral edge to a second lateral edge, the first lateral edge and the second lateral edge detachably securable to a rear panel of the protective shoulder pad.

In certain aspects, a first strap is secured to the central panel and a second strap is secured to the movable panel, the first strap interlaced with the second strap to constrain an amplitude of movements of the movable panel relative to the central panel.

BRIEF DESCRIPTION OF THE DRAWINGS

Reference is now made to the accompanying figures in which.

DETAILED DESCRIPTION

The present disclosure pertains to shoulder pads suitable for players of a wide range of physiologies. The disclosed shoulder pads includes a central panel, side panels, and a movable panel that is movable relative to the central panel to accommodate these physiologies. Hence, the disclosed shoulder pads may provide adequate coverage for a wide range of players and being customable to properly fit different physiological features of those players without impeding the wearer's mobility while provide injury protection.

Figure 1:
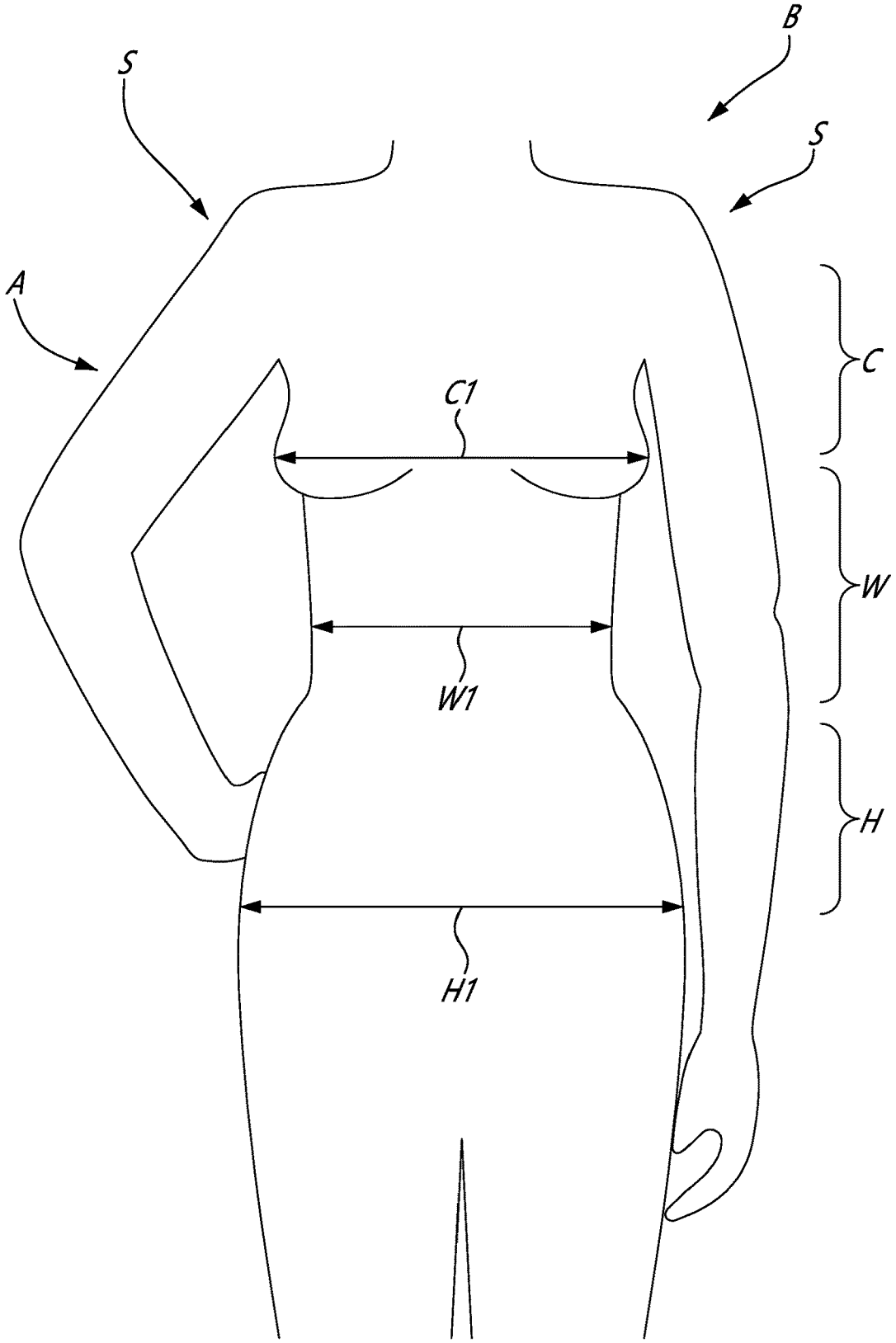
FIG. 1 is a schematic view of the anatomy of a female body.

FIG. 1 schematically illustrates an anatomy of a torso of a female body B including chest C, waist W, and hips H. Typically, the dimension, such as a circumference or width, H1 of the hips H is greater than a circumference or width W1 of the waist W. The circumference or width C1 of the chest C may also vary greatly from one person to another (e.g., male to female) depending on body type, ribcage (band) size and/or cup size. The standard deviation of the ratio of the width C1 of the chest C to the width W1 of the waist W may be less for men than it is for women, mainly because of the higher variability in chest sizes in women.

Although the term "width" is used herein to refer to the dimensions C1, W1 and H1 of the chest, waist and hips, respectively, it is to be understood that a circumference of the body at these locations could also be used as a reference measurement in place of a planar width.

Most existing protective sports equipment in general, and most ice hockey protective equipment in particular, has historically not been designed with female wearers/players in mind. For female athletes, and in particular for female hockey players, the above-noted physiological differences can result in a sub-optimal equipment fit. For example, a woman having a larger than average chest size may need to buy a shoulder pad of a larger size that would otherwise be required for her shoulders (e.g. a size-Large ("L") to accommodate her chest size). However, such a size-Large shoulder pad may be too wide for her shoulder S and/or too loose at her waist W.

A protective shoulder pad assembly, which may also be referred to herein as "protective shoulder pad", "shoulder pad" or simply a "pad", is shown generally at 10 in the subsequent figures. This protective shoulder pad may be of the type worn to protect the wearer during sporting activities, including but not limited to ice hockey.

As will be described below, the shoulder pads 10 (which may also be referred to in the singular, as a "shoulder pad") are adjustable to cater to a variety of chest sizes and may at least partially alleviate the aforementioned problems. The shoulder pads 10 as described herein are particularly designed for women, given the aforementioned challenges which exist for female hockey players to find adequately fitting equipment that is specifically intended for their anatomy. More specifically, the present shoulder pads 10 are particularly intended to permit greater bust accommodating adjustability, in order to permit women having different bust sizes to be both comfortable and well protected, while providing suitable mobility when wearing the shoulder pads 10. However, it is to be understood that the shoulder pad as described herein could similarly be worn by men, and may simply be used should a better fit be required such as to suit the particular anatomy of the wearer, regardless of their gender. The shoulder pad 10 of the present disclosure accordingly provide additional adjustment and/or fit options for a variety of hockey players, including but not limited to those who have a physiology that is outside the standard "norm" for which such protective equipment is typically designed.

Figure 2:
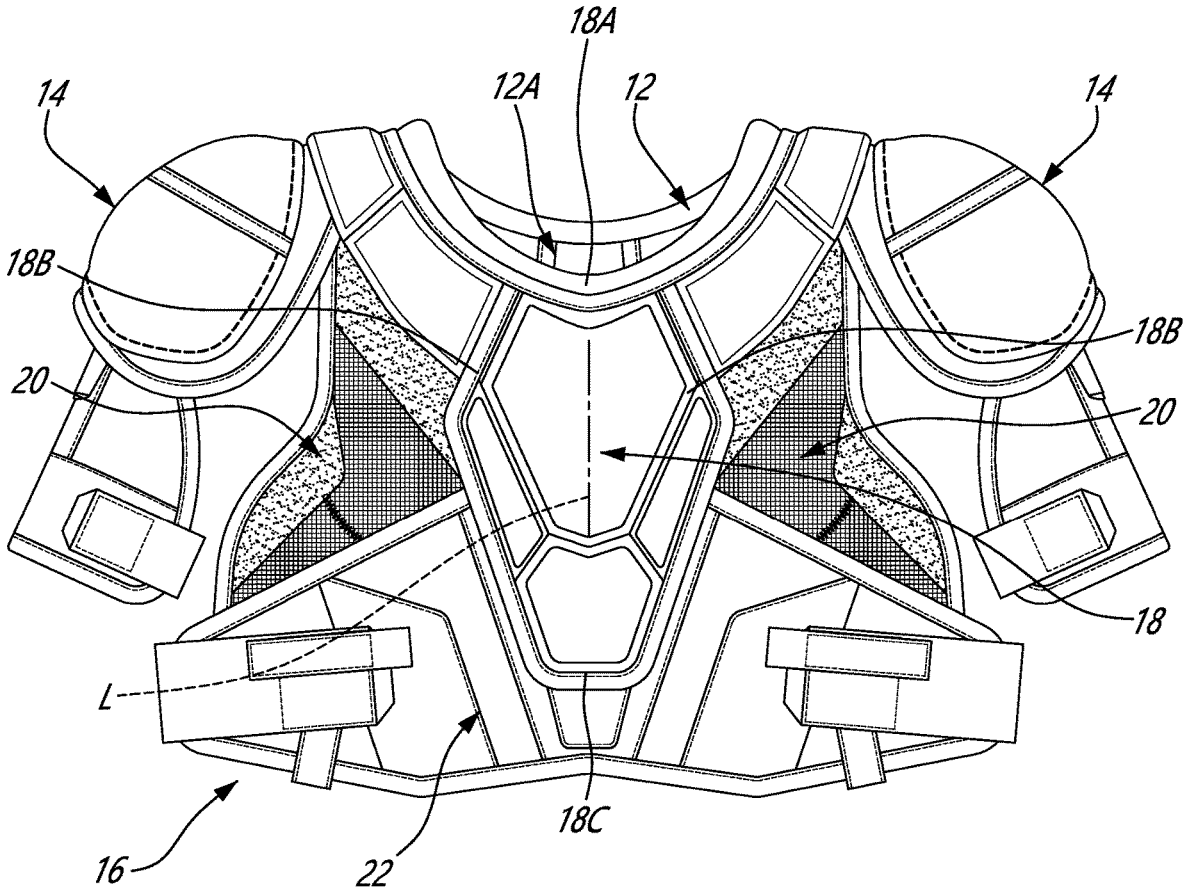
FIG. 2 is a front view of a shoulder pad in accordance with one embodiment.
Figure 3:
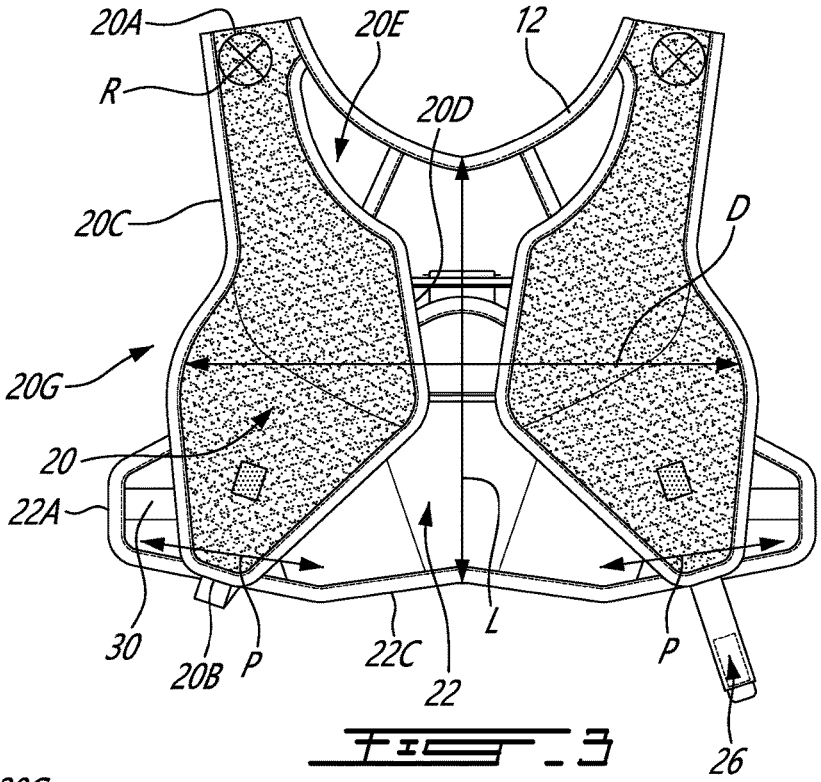
FIG. 3 is a rear view of a front panel assembly of the shoulder pad of FIG. 2, shown in a collapsed configuration.

Referring now to FIGS. 2-3, a front view of the shoulder pads 10 is shown in FIG. 2 whereas FIG. 3 illustrates a rear view of a front panel assembly of the shoulder pads 10.

The shoulder pad 10 includes a neck portion 12 defining a neck opening 12A; shoulder portions 14 that may extend from the neck portion 12 and configured for covering shoulders S (FIG. 1) and parts of arms A (FIG. 1) of the wearer B; and a front panel assembly 16, which may extend from the neck portion 12. The front panel assembly 16 is part of the front portion of the shoulder pad 10 and may be configured to cover the chest C of the wearer.

The neck portion 12 may include padding elements distributed in a way to enhance protection of key parts of the body B. The neck portion 12 may include a plurality of padding elements that may be distributed around the neck opening 12*a*. The padding elements may be contained within pockets defined by a fabric casing and separated from one another by stitch lines. Other configurations are contemplated. The back portion of the shoulder pad 10 may include panels, namely a central rear panel and two side rear panels attached to the central rear panel; the central and side rear panels extending from the neck portion 12. Each of the central and side rear panels may include one or more padding element for protection of a back of the wearer.

In the present embodiment, the front panel assembly 16 includes a sternum-covering panel or central panel 18, two chest-covering panels or side panels 20 that may be movable toward and away from one another to provide a width adjustability of the shoulder pad 10 in its chest area as will be described below, and a movable panel 22 that may be moved vertically to also provide an adjustability of the shoulder pad 10 in its chest area as will be described below. In the context of the present disclosure, a vertical direction is parallel to a centerline L of the shoulder pads 10 and extend towards and away from the neck portion 12 of the shoulder pads 10. An overlap may be present between the side panels 20 and the central panel 18 and the movable panel 22. The side panels 20 may be located between the chest C (FIG. 1) of the wearer B and the central panel 18. More specifically, the shoulder pads 10 may define a upper body-receiving inner volume between the front panel assembly 16 and the rear panel and sized to accommodate at least a portion of an upper body of the wearer. This upper body includes parts of the chest and back of the wearer. Thus, the side panels 20 may be located between this upper body-receiving inner volume and the central panel 18. The central panel 18 may be an outer-most layer of the front panel assembly 16 of the shoulder pads 10 in this embodiment.

The central panel 18 is detachably secured to the movable panel 22. Fastening means, such as hook-and-loop fasteners, snap buttons, straps, and so on may be used to secure the central panel 18 to the movable panel 22. The central panel 18 overlaps the movable panel 22. The central panel 18 may be disposed over the movable panel 22 such that the movable panel 22 is disposed between the central panel 18 and a wearer of the shoulder pad 10. In the embodiment shown, a first strap is secured to the central panel 18 and a second strap secured to the movable panel 22. The first strap is interlaced with the second strap to constrain an amplitude of movements of the movable panel 22 relative to the central panel 18.

Still referring to FIG. 2, in the embodiment shown, the central panel 18 has a top edge 18A secured to the neck portion 12. In some embodiments, the central panel 18 may be detachably secured to the neck portion 12. In a particular embodiment, the central panel 18 may define a portion of the neck portion 12. The top edge 18A of the central panel 18 may be curved to follow a shape of the neck opening 12A. The movable panel 22 may be wider than the central panel 18. The central panel 18 is centered relative to the centerline L of the shoulder pads 10 and includes two lateral edges 18B disposed on opposite sides of the centerline L. The central panel 18 has a bottom edge 18C connected to the two lateral edges 18B. The bottom edge 18C may be located proximate the waist W (FIG. 1) of the wearer B when worn.

As shown in FIG. 2, the central panel 18 may cover a portion of the chest C (FIG. 1) of the wearer B (FIG. 1); the portion including a sternum of the wearer. At least a portion of a remainder of the chest C of the wearer B may be covered by the side panels 20 and by the movable panel 22. The central panel 18 may have padding elements distributed longitudinally along the centerline L and able to pivot one relative to the other about hinge lines, which may correspond to stitch lines that separates the padding element from one another. The ability of the padding elements of the central panel 18 to pivot one relative to the other may allow the front panel assembly 16 to more closely follow a shape of the chest C (FIG. 1) of the wearer B than an alternate embodiment having solely one padding element. The hinge lines may be created by local reduction in a thickness of the padding elements. Put differently, the hinge lines may separate an inner volume of the central panel 18 between two or more sub-volumes disconnected from one another and each receiving a respective padding element. Alternatively, a single monolithic padding element may fill an entirety of the inner volume of the central panel 18 and the stitch lines are used to locally reduce the thickness of this single monolithic padding element such as to create weaker region permitting flexion. The stitch lines therefore define pivot axes of the central panel 18.

For female wearers, or male wearers requiring additional chest space, these hinge lines may allow the front panel to conform more accurately to a shape of their chest C. Lateral stitch lines are used to separate the central padding elements from lateral padding elements and may act as lateral hinge lines to allow the lateral padding elements to pivot relative to the central padding elements to follow a curvature of the body of the wearer at her waist W (FIG. 1). Those lateral hinge lines may be substantially parallel to the centerline L or slightly angled relative to the centerline L.

As previously discussed, a size of the chest C (FIG. 1) of a female wearer is highly dependent upon her band size and/or cup size. That is, a female wearer may have a shoulder size requiring a small (S) version of a shoulder pad but, because of her chest/cup size, said wearer may require to use a large (L) version of said shoulder pad. A size large may be adequately shaped for the chest C of said wearer, but may be too big for her shoulder S and/or hips H (FIG. 1). This may be problematic as the protection conferred to the wearer may be inadequate, which results in discomfort or potential injury. If said wearer buys the small version of the shoulder pad, portions of her chest C may remain uncovered and/or unprotected by the shoulder pad, or the pad may simply be uncomfortable to wear because it is too tight in the chest area.

As will be described herein below, the front panel assembly 16 of the disclosed shoulder pad 10 may be adjustable in width to accommodate female players having a variety of torso sizes (and in particular chest sizes).

As illustrated in FIG. 2, each of the side panels 20 may be secured to a respective one of rear side panels of the rear portion at their respective top edges and proximate the neck portion 12. The side panels 20 may be secured to the rear side panels via stitch lines. The top edges of both of the side panels 20 and the rear side panels may be located at a top most portion of the shoulder pad 10. The top most portion may correspond to a location where the shoulder pad lays against a top sections of the shoulders of the wearer.

Herein, the expression "secured" may include "stitched". It is however understood that any other suitable methods of securing or attached the portions together are contemplated without departing from the scope of the present disclosure, including for example fabric welding, bonding, etc.

Figure 4:
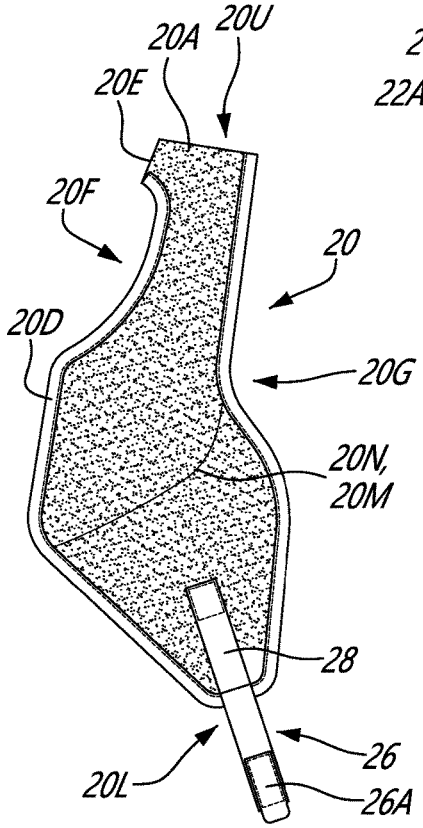
FIG. 4 is a front view of one of two side panels of the front panel assembly of FIG. 3.

Referring now to FIGS. 3-4, a rear view of the front panel assembly 16 and a front view of one of the side panels 20 are shown. In the embodiment shown, each of the side panels 20 has an upper end 20U and an opposed lower end 20L. Each of the side panels 20 has a top edge 20A at the upper end 20U, a bottom edge 20B at the lower end 20L, and outer and inner lateral edges 20C, 20D extending from the top edge 20A to the bottom edge 20B. The outer edges 20C face away from the centerline L and the inner lateral edges 20D face one another. A first portion 20E of the inner lateral edge 20D of each of the side panels 20 may be secured to the neck portion 12 of the shoulder pad 10. In other words, the upper ends 20U of the side panels 20 are fixed relative to the neck portion 12 of the shoulder pad 10. As illustrated more clearly in FIG. 4, a second portion 20F of the inner lateral edge 20D is free of connection to a remainder of the front panel assembly 16. This may allow the second portion 20F of the inner lateral edges 20D of the side panels 20 to move relative to the neck portion 12 of the shoulder pad 10. In the embodiment shown, the outer edges 20C of the side panels 20 define concave portions 20D that may ease movements of the arms A (FIG. 1) of the wearer B (FIG. 1). In other words, the outer lateral edges 20C of the side panels have a C-shape. The concave portions 20G are oriented away from the centerline L.

Referring to FIG. 4, each of the side panels 20 may define one (or more) cut-out 20M extending from the outer edges 20C toward the inner lateral edges 20D. The cut-outs 20M may be delimited by two opposed edges 20N that may be stitched together. A pattern of the side panel 20 may define the cut-out having a V-shape; the pattern being substantially flat. Upon stitching the two opposed edges 20N of the cut-outs 20M, the "V" is closed thereby causing the side panels 20 to form a cup shape for receiving a portion of the chest C (FIG. 1) of the wearer. In sewing, the cut-outs 20M may be referred as darts configured to provide a shape to the side panels 20.

Figure 5:
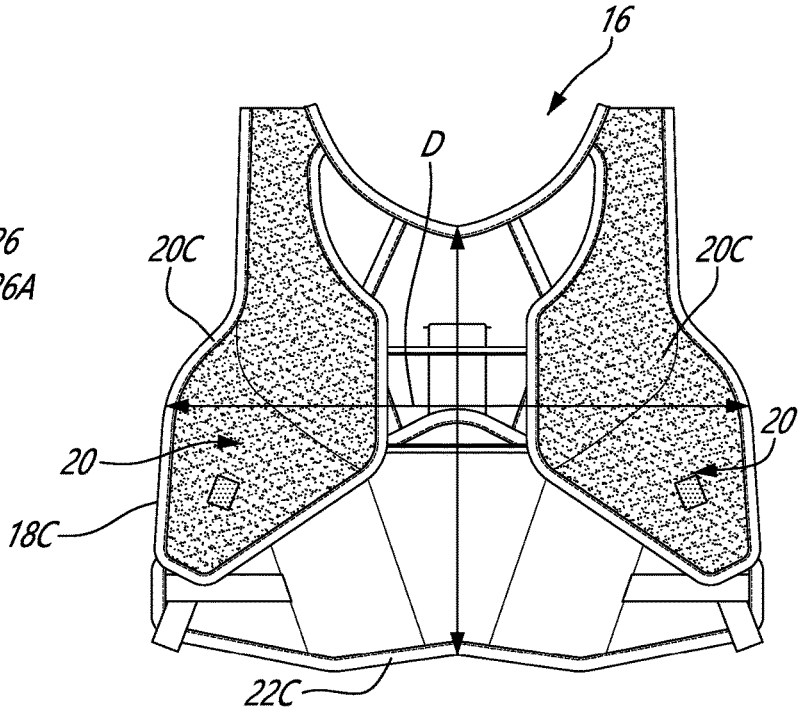
FIG. 5 is a rear view of the front panel assembly of the shoulder pad of FIG. 3, shown in an expanded configuration.

Referring to FIGS. 3-7, the lower ends 20L of the side panels 20 are laterally movable relative to the central panel 18 and the neck portion 12; FIG. 3 illustrating an intermediary position whereas FIG. 5 illustrates a fully extended position. The lower ends 20L may move in a direction being substantially transverse to the centerline L. Rotation axes R (FIG. 3) may be defined at the upper ends 20U of the side panels 20; the side panels 20 being pivotable or rotatable about the rotation axes R, such that the lower ends 20L thereof pivot about the rotation axes R along an arcuate travel path P (see FIGS. 3 and 4) to thereby change a lateral position of the lower ends 20L relative to the central panel 18.

Figure 6:
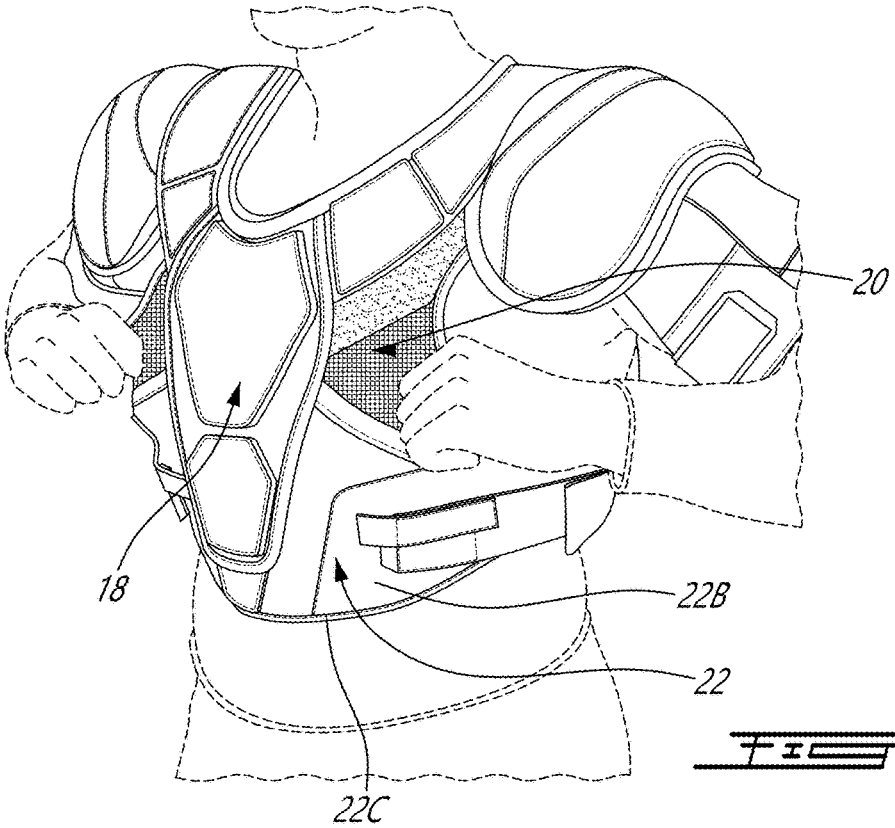
FIG. 6 is a three-dimensional view of the shoulder pad of FIG. 2 on a wearer, and shown in the collapsed configuration of FIG. 3.
Figure 7:
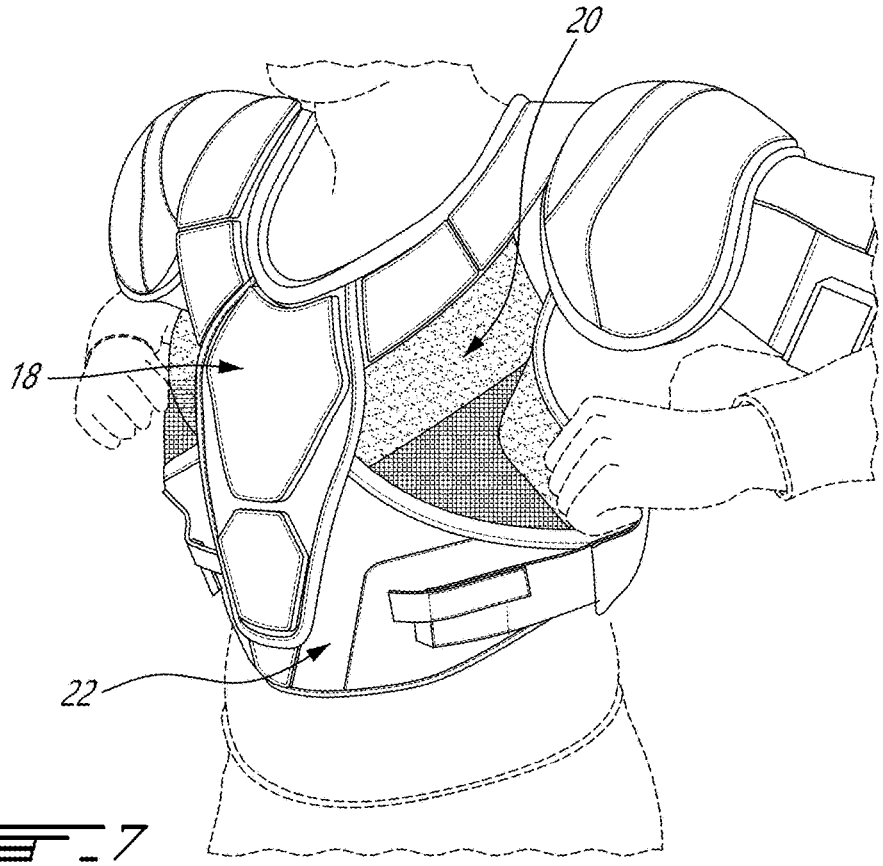
FIG. 7 is a three-dimensional view of the shoulder pad of FIG. 2 on the wearer, and shown in the expanded configuration of FIG. 5.

As shown in FIGS. 6-7, such a movement of the side panels 20 may allow to increase a width D (FIG. 5) of the front panel assembly 16 by increasing the distance between the outer edges 20C of the two side panels 20. The width D of the front panel assembly 16 may be decreased by moving the side panels 20 toward one another (FIG. 6) and increased by moving the side panels 20 away from one another (FIG. 7). The width D is a dimension of the front panel assembly 16 taken transversally to the centerline L.

The disclosed shoulder pad 10 may thus accommodate a plurality of chest/cup sizes of female players. For instance, a woman having a larger than average cup size that would normally require her to buy a large version of a shoulder pad that would be too wide for her shoulders, may now wear a small version of the shoulder pad 10 to properly fit her shoulders S (FIG. 1) and may choose to increase a distance between the outer edges 20*c* of the side panels 20, to increase the width D of the front panel assembly 16, to better cover her chest C (FIG. 1). An overall fit of a small version of the disclosed shoulder pad 10 having the side panels 20 spaced apart from one another at a maximum distance may be better than that of a larger version of a shoulder pad not shown herein.

Referring more particularly to FIG. 5, in the fully extended position, the outer lateral edges 20C of the side panels 20 are at least partially aligned with two lateral edges 22A (FIG. 3) of the movable panel 22. More specifically, in the fully extended position, the two side panels 20 may remain covered by movable panel 22. Other configurations are contemplated.

Referring now to FIGS. 4 and 6, the lower ends 20L of the side panels 20 are removably securable to the movable panel 22 at a plurality of attachment points defined by the movable panel 22 to adjust the width D of the front panel assembly 16. In the embodiment shown, the movable panel 22 defines attachment surface(s) 22B matingly engageable by tabs 26 secured to the side panels 20. Thus, the movable panel 22 is securable to the side panels 20 at any of the plurality of positions, which include the upper-most and the lower-most positions. In other words, the movable panel 22 is movable along the centerline L relative to the central panel 18 at any point between the upper and lower-most positions. The tabs 26 may extend from the bottom edges 20B of the side panels 20 and away from the side panels 20. Herein, the attachment surfaces 22B are located on an outer side of the movable panel 22; the outer side facing away from the wearer. More specifically, the tabs 26 define attachment surfaces 26A configured to cooperate with the attachment surfaces 22B of the movable panel 22. In the embodiment shown, the attachments surfaces 22B, 26A of the movable panel 22 and of the tabs 26 define hook-and-loop fasteners, such as Velcro™. Any other connection means, such as snap connectors, buttons, laces, and so on may be used without departing from the scope of the present disclosure.

In the embodiment shown, the tabs 26 are secured to the side panels 20 proximate the bottom edges 20B and have a length sufficient to allow the tabs 26 to wrap around a bottom edge 22C of the movable panel 22 and to reach the attachment surface 22B located on the outer side of the movable panel 22. In other words, a portion of the movable panel 22 is sandwiched between the tabs 26 and the side panels 20. Alternatively, the tabs 26 may be omitted and fastening surfaces may be located on the side panels 20, and the attachment surfaces 22B of the movable panel 22 may be located on an inner side of the movable panel 22 to face toward the side panels 20.

Figure 8:
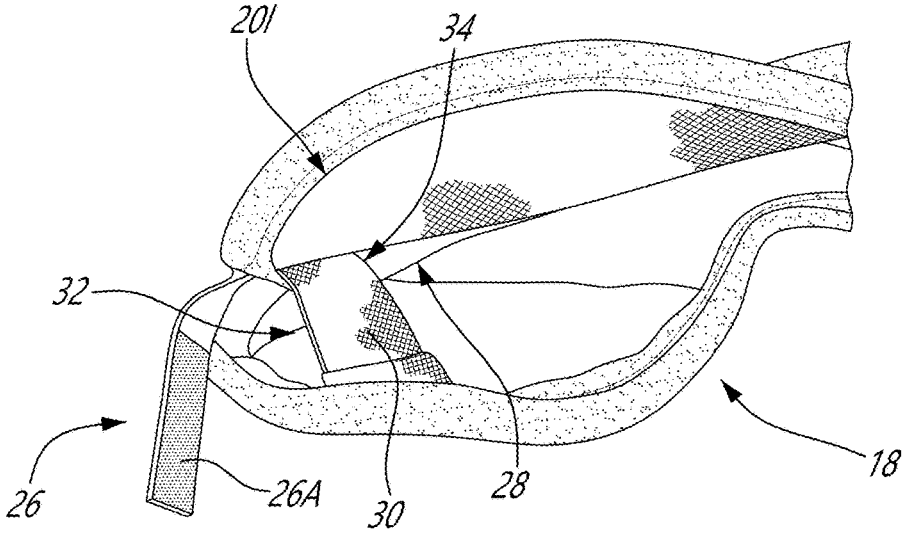
FIG. 8 is a side view of the front panel assembly of the shoulder pad of FIG. 2, illustrating an attachment between a central panel and one of the side panels.

Referring to FIGS. 4 and 8, to limit movements of the side panels 20 relative to the movable panel 22, the side panels 20 and the movable panel 22 have straps, or webbings, 28, 30 secured thereto. Each of the straps 28, 30 is secured to either one of the side panels 20 or the movable panel 22 at two attachments points and is free of connection to the one of the side panels 20 or the movable panel 22 between the two attachment points to define openings 32, 34. Each of the openings, or sleeves, 32, 34 defined by a corresponding one of the straps 28 of the side panels 20 and the straps 30 of the movable panel 22 receives the other of the straps 28 of the side panels 20 and the straps 30 of the movable panel 22. Stated differently, each of the straps 28, 30 is received within one of the openings 32, 34 defined by the other of the straps. In other words, for each of the side panels 20, the two straps 28, 30 are interlocked to limit an amplitude of movements of the side panels 20 relative to the movable panel 22. The interlocking between the two straps 28, 30 allow a sliding motion one relative to the other. A size of the sleeves or openings is greater than the widths of the straps to allow said sliding motion.

Figure 9:
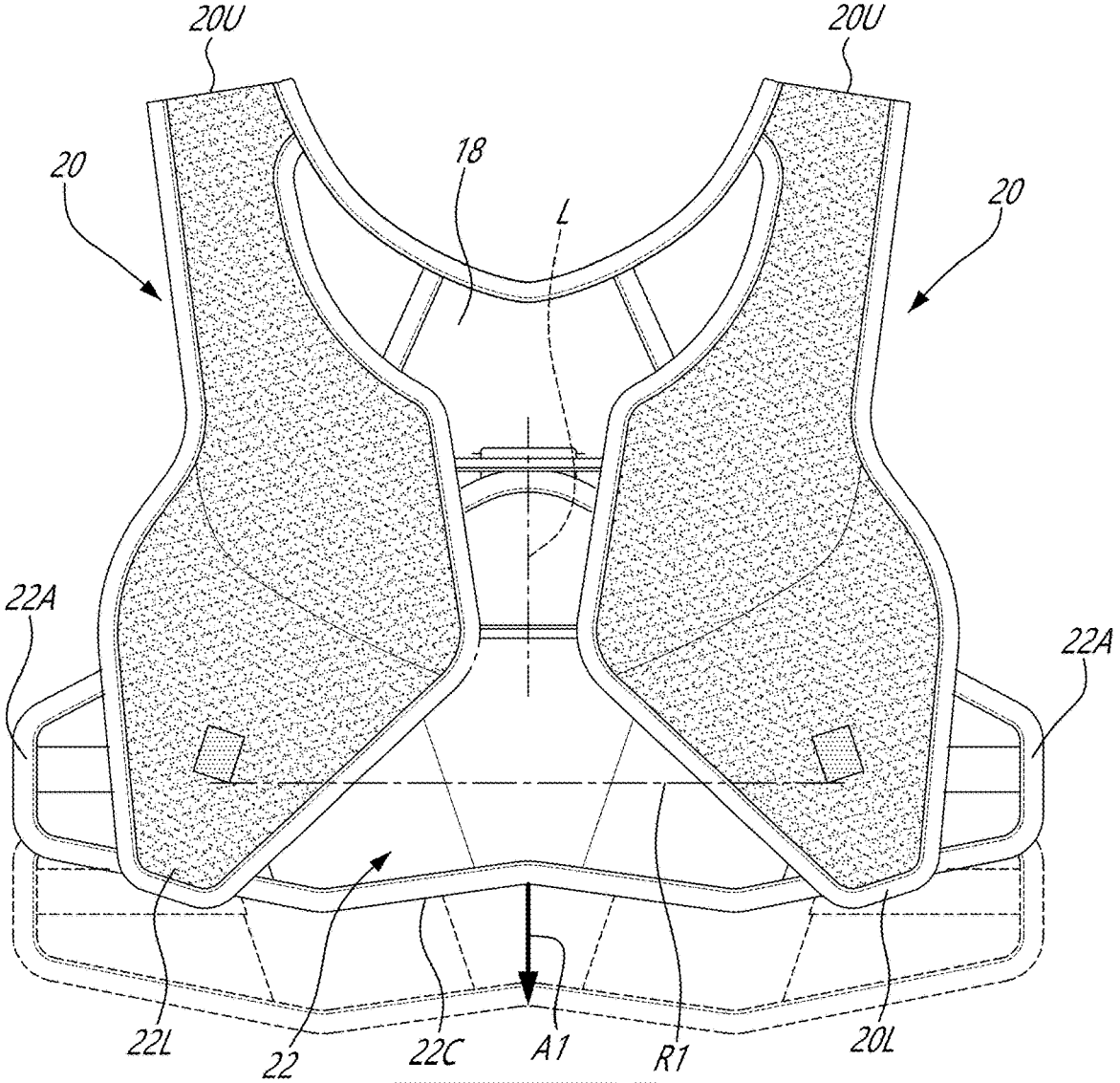
FIG. 9 is a rear view of the front panel assembly of the shoulder pad of FIG. 2 illustrating a movable panel thereof in two possible positions.

Referring now to FIG. 9, as illustrated, the movable panel 22 is movable vertically along a direction denoted by arrow A1, which is parallel to the centerline L of the shoulder pad 10. The direction has a component parallel to the centerline of the central panel 18. The movable panel 22 overlaps the side panels 20 and is movable relative to the central panel 18 (shown in greyed out) between at least two positions. In other words, the movable panel 22 is positionable at a plurality of positions relative to the central panel 18. The plurality of positions includes an upper-most position and a lower-most position. An overlapping area between the movable panel 22 and the side panels 20 varies between the upper-most positions and the lower-most positions. The overlapping area is greater in the upper-most position than in the lower-most position. The movable panel 22 is closer to the neck portion 12 in the upper-most position than in the lower-most position. In FIG. 9, the movable panel 22 is shown in the upper-most position in dark lines and in the lower-most position with greyed out lines. A distance between the upper edge 22D of the movable panel 22 and the neck portion 12 varies between the at least two positions. As will be discussed below, a chest-receiving cavity of the front panel assembly 16 is greater in depth as the movable panel 22 moves downwardly away from the neck portion 12. The chest-receiving cavity may be defined conjointly by the side panels 20 and the central panel 20. The chest-receiving cavity is greater in depth in the lower-most position of the movable panel 22 than in the upper-most position. The depth extends from the front panel towards a rear panel facing a back of the wearer. The depth may therefore be a dimension being substantially perpendicular to the front panel and extends transversally to the centerline L.

As previously discussed, the upper ends 20U of the side panels 20 are fixed relative to the neck portion 12. The lower ends 20L of the side panels 20 are laterally displaceable relative to the central panel 18 and the neck portion 12 to adjust the width of the front panel assembly defined between outer lateral edges of the side panels 20. The side panels 20 may be rotatable about the upper ends 20U to adjust the width of the front panel assembly.

Figure 10B:
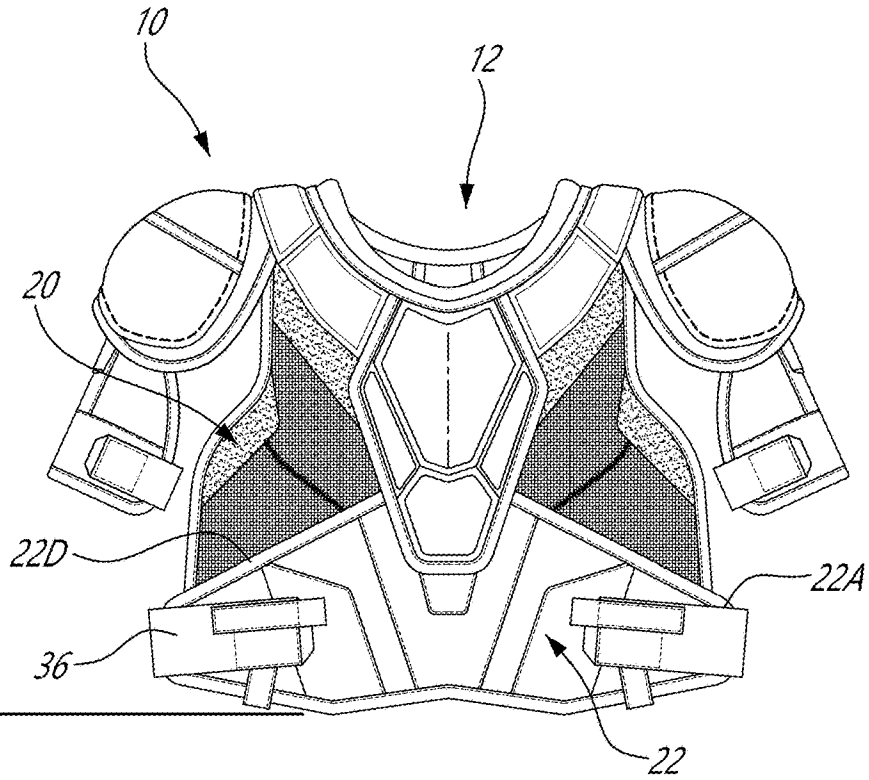
FIG. 10B illustrate a front view of the shoulder pad of FIG. 10 with the movable panel in a lower-most position.
Figure 10A:
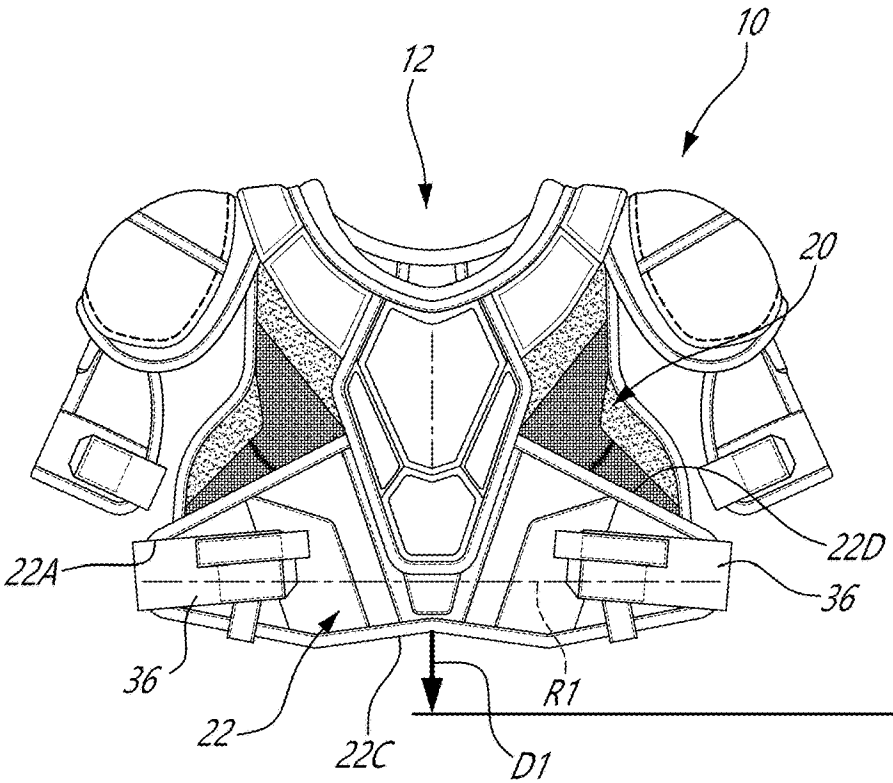
FIG. 10A illustrate a front view of the shoulder pad of FIG. 10 with the movable panel in an upper-most position.

Referring more particularly to FIGS. 10A and 10B, two front views of the shoulder pad 10 are displayed. The shoulder pad 10 is shown with the movable panel 22 in the upper-most position on FIG. 10A and shown in the lower-most position on FIG. 10B. As illustrated, a distance between a bottom of the movable panel 22 and the neck portion 12 may vary by a distance D1 taken along the centerline L. Moreover, when the movable panel 22 is in the lower-most position depicted on FIG. 10B, a greater surface area of the side panels 20 is visible and uncovered by the movable panel 22. This may allow the side panels 20 to deflect outwardly away from a back or rear portion of the shoulder pad 10. The movement of the movable panel 22 away from the neck portion 12 may increase a length of the front panel assembly 16. Stated differently, by decreasing an amount of overlap between the movable panel 22 and the side panels 20, the side panels 20 may be more flexible and free to deflect to more adequately conform to a shape of the chest of the wearer. Indeed, a stiffness of a combination of the side panels 20 and movable panel 22 may be decreased by decreasing the amount of overlap between these panels at least because the portion of the side panels 20 that was overlapped by the movable panel 22 is now more free to deflect since it is no longer overlapped by the movable panel 22 when the movable panel 22 is moved downwardly. Again in other words, the movable panel 22 may stiffen the side panels 20 by overlapping them. This stiffening effect may be at least partially reduced by decreasing the overlap between the side panels 20 and the movable panel 22. This may provide a configuration more suitable to conform to bigger cup sizes of the wearer.

As previously discussed, the lower ends 20L of the side panels 20 are detachably secured to the movable panel 22. Consequently, the movable panel 22 may rotate about an axis R1 (FIG. 10A) transverse to the centerline L as the movable panel 22 translates from the upper-most position to the lower-most position. In fact, the movable panel 22 experiences a compound movement of a translation along the centerline L and a rotation about the axis R1. The rotation of the movable panel 22 about the axis R1 as the movable panel 22 moves towards the lower-most position increases a distance between the side panels 20 and a rear panel of the protective shoulder pads; the rear panel facing a back of the wearer. In other words, the movable panel 22 is rotatable about the axis R1, which is transverse to the centerline L, with a movement of the movable panel 22 along the centerline L to vary the depth of the chest-receiving cavity.

As shown in FIGS. 10A-10B, as the movable panel 22 is translated downwardly away from the neck portion 12 and along the centerline L, a top edge 22D of the movable panel 22 may move away from a back or rear portion of the shoulder pad 10 as the movable panel 22 rotates about the axis R1 because the movable panel 22 has its bottom edge 22C secured to the lower ends 20L of the side panels 20. This may result in the chest-receiving cavity of the front panel assembly 16 increasing in depth from the upper-most position to the lower-most position via the rotation of the movable panel 22 about the axis R1 transverse to the centerline L and via the translation of the movable panel 22 away from the neck portion 12 and along the centerline L.

Figures 11A, 11B, 11C:
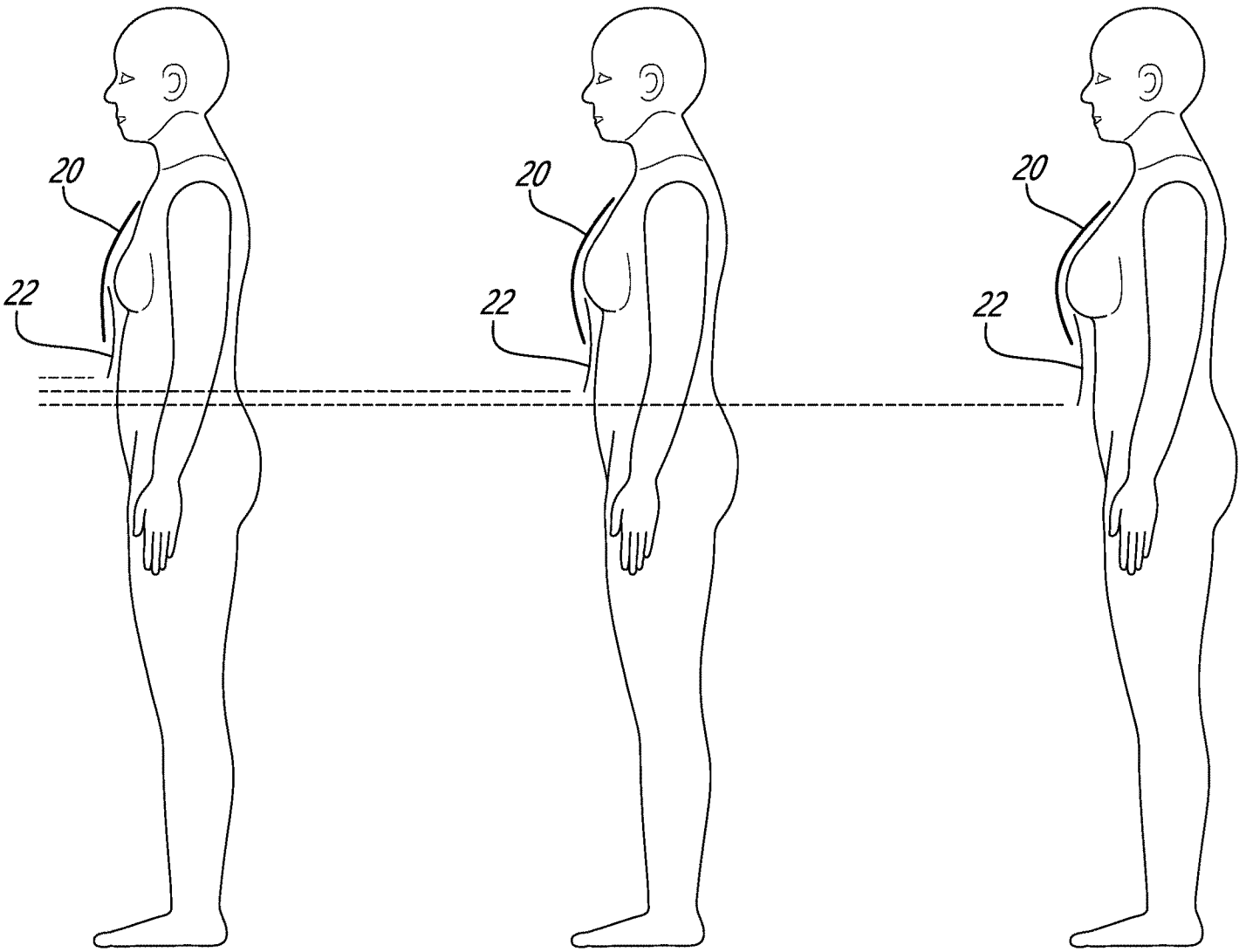
FIGS. 11A to 11C show three different wearer wearing the shoulder pad of FIG. 2 in three possible configurations.

Put differently, and referring concurrently to FIGS. 11A to 11C, the combined translation and rotation of the movable panel 22 increases a surface area of the side panels 20 and/or of the central panel 18 uncovered by the movable panel 22 (see FIG. 11C compared to FIG. 11A) and may increase a space between the top edge 22*d* of the movable panel 22 and the rear or back portion of the shoulder pad 10 thereby providing sufficient space for the side panels 20 to deflect outwardly to accommodate a wearer having a bigger chest. Therefore, a curvature of the side panels 20 may increase as the movable panel 22 is moved downwardly towards the lower-most position. As shown in FIGS. 11A to 11C, as the movable panel 22 is moved downwardly, the side panels 20 are less and less overlapped by the movable panel 22 thereby allowing a curvature of the side panels 20 to increase.

Referring back to FIGS. 10A-10B, in the embodiment shown, the lateral edges 22A of the movable panel 22 are detachably secured to the rear or back portion of the shoulder pad 10 via straps 36. These straps 36 may define fastening surfaces cooperating with the attachment surfaces 22B of the movable panel 22. These straps 36 may be secured to the attachment surfaces 22B by hook-and-loop fasteners, snap buttons, or any other suitable fastening means. These straps 36 may be elastic. They may be adjustable in length in an alternate embodiment.

Figure 12:
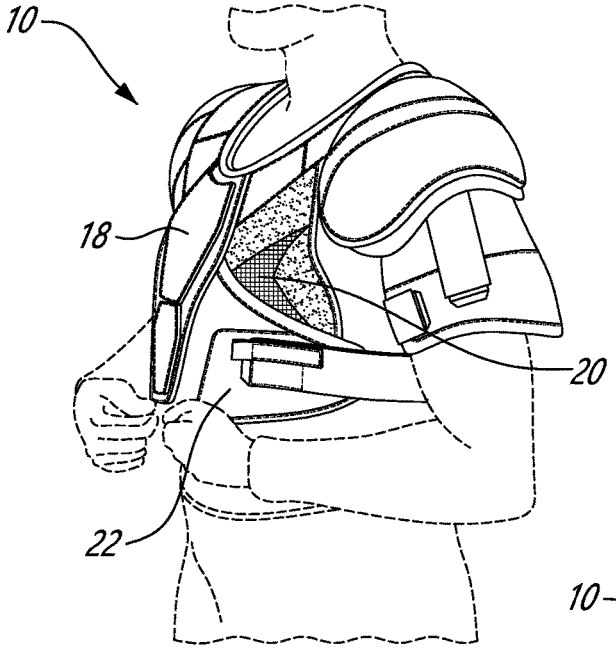
FIG. 12 is a three-dimensional view of the shoulder pad of FIG. 2 on the wearer, and illustrating the movable panel of FIG. 10 in an upper-most position.
Figure 13:
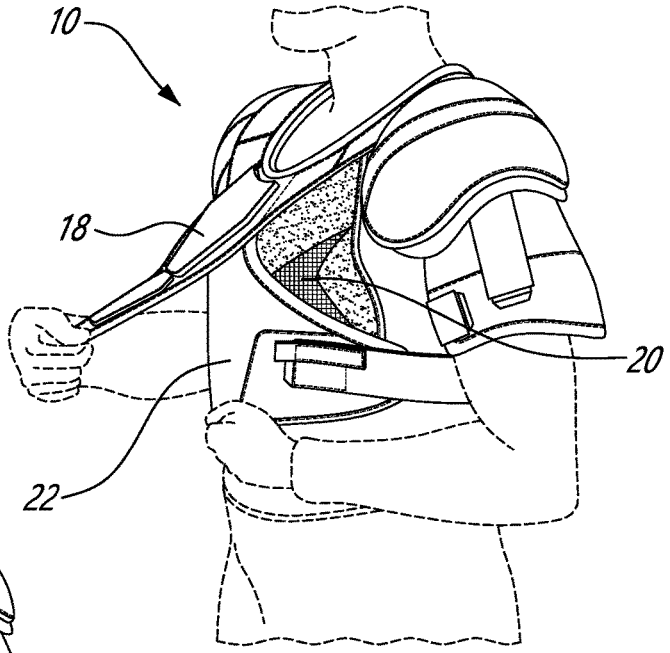
FIG. 13 is a three-dimensional view of the shoulder pad of FIG. 2 on the wearer, and illustrating the movable panel of FIG. 10 in an intermediate position.
Figure 14:
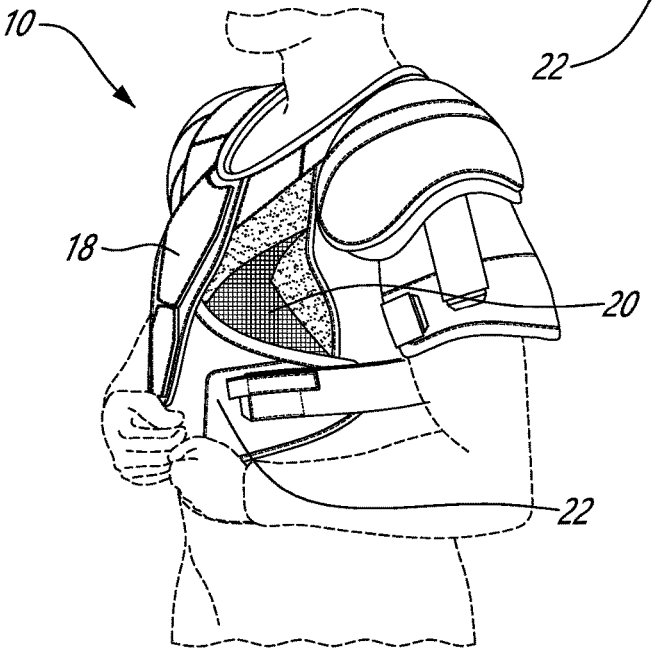
FIG. 14 is a three-dimensional view of the shoulder pad of FIG. 2 on the wearer, and illustrating the movable panel of FIG. 10 in a lower-most position.

Referring more particularly to FIGS. 12-14, to adjust the shoulder pad 10, the wearer may detach the central panel 18 from the movable panel 22. This may be done by pulling the central panel 18 away from the wearer and away from the movable panel 22 (FIG. 12). The wearer may then move the movable panel 22 to a desired position in which the side panels 20 are able to adequately deflect outwardly to increase a size of the chest-receiving cavity to accommodate the chest of the wearer (FIG. 13). Then, once the position of the movable panel 22 and once the side panels 20 adequately conform to a shape of the chest of the wearer, the wearer may attach the central panel 18 to the movable panel 22 to lock the position of the movable panel 22 relative to the central panel 18.

The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications could be implemented by a person of ordinary skill in the art in view of the present disclosure, which modifications would be within the scope of the present technology.

The invention claimed is:

1. Protective shoulder pads, comprising:

a neck portion defining a neck opening configured for receiving a head of a wearer;

shoulder portions attached to the neck portion and configured for covering shoulders and parts of arms of the wearer; and a front panel assembly extending from the neck portion and configured for covering a chest of the wearer, the front panel assembly defining a chest-receiving cavity for receiving a portion of the chest, the front panel assembly having:

a central panel secured to the neck portion in a fixed position and extending downwardly from the neck portion along a centerline of the protective shoulder pad, side panels disposed on opposite sides of the centerline, and a movable panel overlapping the side panels, the movable panel extending transversely relative to the centerline and being movable relative to the central panel and along the centerline, the movable panel being positionable at a plurality of positions relative to the central panel, the plurality of positions including an upper-most position and a lower-most position, an overlapping area between the movable panel and the side panels greater in the upper-most position than in the lower-most position, the chest-receiving cavity being greater in depth in the lower-most position than in the upper-most position of the movable panel, the depth extending from the front panel assembly towards a rear panel facing a back of the wearer.

2. The protective shoulder pads of claim 1, wherein the movable panel rotates about an axis transverse to the centerline when moving downwardly along the centerline to increase a distance between the side panels and the rear panel of the protective shoulder pads facing a back of the wearer.

3. The protective shoulder pads of claim 1, wherein upper ends of the side panels are fixed relative to the neck portion, lower ends of the side panels being displaceable transversally to the centerline and relative to the central panel and the neck portion to adjust a width of the front panel assembly, the width defined between outer lateral edges of the side panels.

4. The protective shoulder pads of claim 1, wherein the movable panel is securable to the side panels at both of the upper-most position and the lower-most position.

5. The protective shoulder pads of claim 4, wherein the movable panel is securable to the side panels at a plurality of intermediate positions between the upper-most position and the lower-most position.

6. The protective shoulder pads of claim 1, wherein lower ends of the side panels are detachably secured to the movable panel.

7. The protective shoulder pads of claim 1, wherein a curvature defined by the side panels is greater in the lower-most position than in the upper most position of the movable panel.

8. The protective shoulder pads of claim 1, wherein the central panel overlaps the movable panel.

9. The protective shoulder pads of claim 8, wherein the central panel is disposed over the movable panel such that the movable panel is disposed between the central panel and a wearer of the shoulder pad.

10. The protective shoulder pads of claim 1, wherein the movable panel extends laterally from a first lateral edge to a second lateral edge, the first lateral edge and the second lateral edge detachably securable to the rear panel of the protective shoulder pad.

11. The protective shoulder pads of claim 1, comprising a first strap secured to the central panel and a second strap secured to the movable panel, the first strap interlaced with the second strap to constrain an amplitude of movements of the movable panel relative to the central panel.

12. Protective shoulder pads having a front panel assembly, the front panel assembly comprising:

a sternum-covering panel extending along a centerline of the protective shoulder pads from a top edge of the sternum-covering panel to a bottom edge of the sternum-covering panel;

chest-covering panels disposed on opposite sides of the centerline, the chest-covering panels and the sternum-covering panel conjointly defining a chest-receiving cavity having a depth extending transversally to the centerline, and a movable panel extending transversally to the sternum-covering panel and being movable along the centerline relative to the sternum-covering panel at any point between an upper-most position and a lower-most position, the movable panel rotatable about an axis transverse to the centerline with a movement of the movable panel along the centerline to vary the depth of the chest-receiving cavity, the depth of the chest-receiving cavity greater in the lower-most position than in the upper-most position of the movable panel.

13. The protective shoulder pads of claim 12, wherein the movable panel overlaps the chest-covering panels and is at least partially overlapped by the sternum-covering panel.

14. The protective shoulder pads of claim 12, wherein upper ends of the chest-covering panels are fixed relative to the sternum-covering panel, lower ends of the chest-covering panels being displaceable transversally to the centerline and relative to the sternum-covering panel to adjust a width of the front panel assembly.

15. The protective shoulder pads of claim 12, wherein the movable panel is securable to the side panels at both of the upper-most position and the lower-most position.

16. The protective shoulder pads of claim 15, wherein the movable panel is securable to the chest-covering panels at a plurality of intermediate positions between the upper-most position and the lower-most position.

17. The protective shoulder pads of claim 12, wherein lower ends of the chest-covering panels are detachably secured to the movable panel.

18. The protective shoulder pads of claim 12, wherein a curvature defined by the chest-covering panels is greater in the lower-most position than in the upper-most position of the movable panel.

19. The protective shoulder pads of claim 12, comprising a first strap secured to the sternum-covering panel and a second strap secured to the movable panel, the first strap interlaced with the second strap to constrain an amplitude of movements of the movable panel relative to the sternum-covering panel.

* * * * *